US006078148A

United States Patent [19]

Hochstein

[11] Patent Number: 6,078,148

[45] Date of Patent: Jun. 20, 2000

[54] TRANSFORMER TAP SWITCHING POWER SUPPLY FOR LED TRAFFIC SIGNAL

[75] Inventor: Peter A. Hochstein, Troy, Mich.

[73] Assignee: Relume Corporation, Troy, Mich.

[21] Appl. No.: 09/169,271

[22] Filed: Oct. 9, 1998

[51] Int. Cl.[7] ..... G05F 1/00

[52] U.S. Cl. ..... 315/291; 307/115; 307/116; 323/355

[58] Field of Search ..... 323/291, 355, 323/359; 307/29, 31, 115, 116; 315/129, 136, 141, 177, 209 R, 212, 254, 291, 307

[56] References Cited

U.S. PATENT DOCUMENTS

| | | | |
|---|---|---|---|
| 3,944,913 | 3/1976 | Kuglar | 307/136 |
| 4,454,466 | 6/1984 | Ritter . | |
| 4,717,889 | 1/1988 | Engelmann . | |
| 4,816,738 | 3/1989 | Nicolas . | |
| 4,896,092 | 1/1990 | Flynn . | |
| 5,170,068 | 12/1992 | Kwiatkownski et al. | 307/31 |
| 5,408,171 | 4/1995 | Eitzmann et al. | 323/258 |
| 5,581,173 | 12/1996 | Yalla et al. | 307/31 |
| 5,633,580 | 5/1997 | Trainor et al. . | |
| 5,661,645 | 8/1997 | Hochstein | 363/89 |
| 5,821,716 | 10/1998 | Okanik | 323/355 |

*Primary Examiner*—Don Wong
*Assistant Examiner*—Thuy Vinh Tran
*Attorney, Agent, or Firm*—Howard & Howard

[57] ABSTRACT

A transformer T1 having a primary winding and a secondary winding each having a plurality of turns 12 and 14 and a plurality of taps 16, 18, 20, 22 and 24 for changing the number of effective turns 12 and 14 of the primary winding. An array of LEDs 36 produce a luminous output in response to power supplied by the transformer T1. The assembly is characterized by a controller 38 for automatically selecting one of the taps 16, 18, 20, 22 or 24 in response to an operating parameter of the LEDs 36 for maintaining the luminous output of said LEDs 36 above a predetermined level. The measurement of the operating parameter may be any one of or any combination of measuring voltage across the LEDs 36, measuring current through the LEDs 36, measuring the temperature of the LEDs 36, or measuring 40 the luminous output of the LEDs 36.

5 Claims, 1 Drawing Sheet

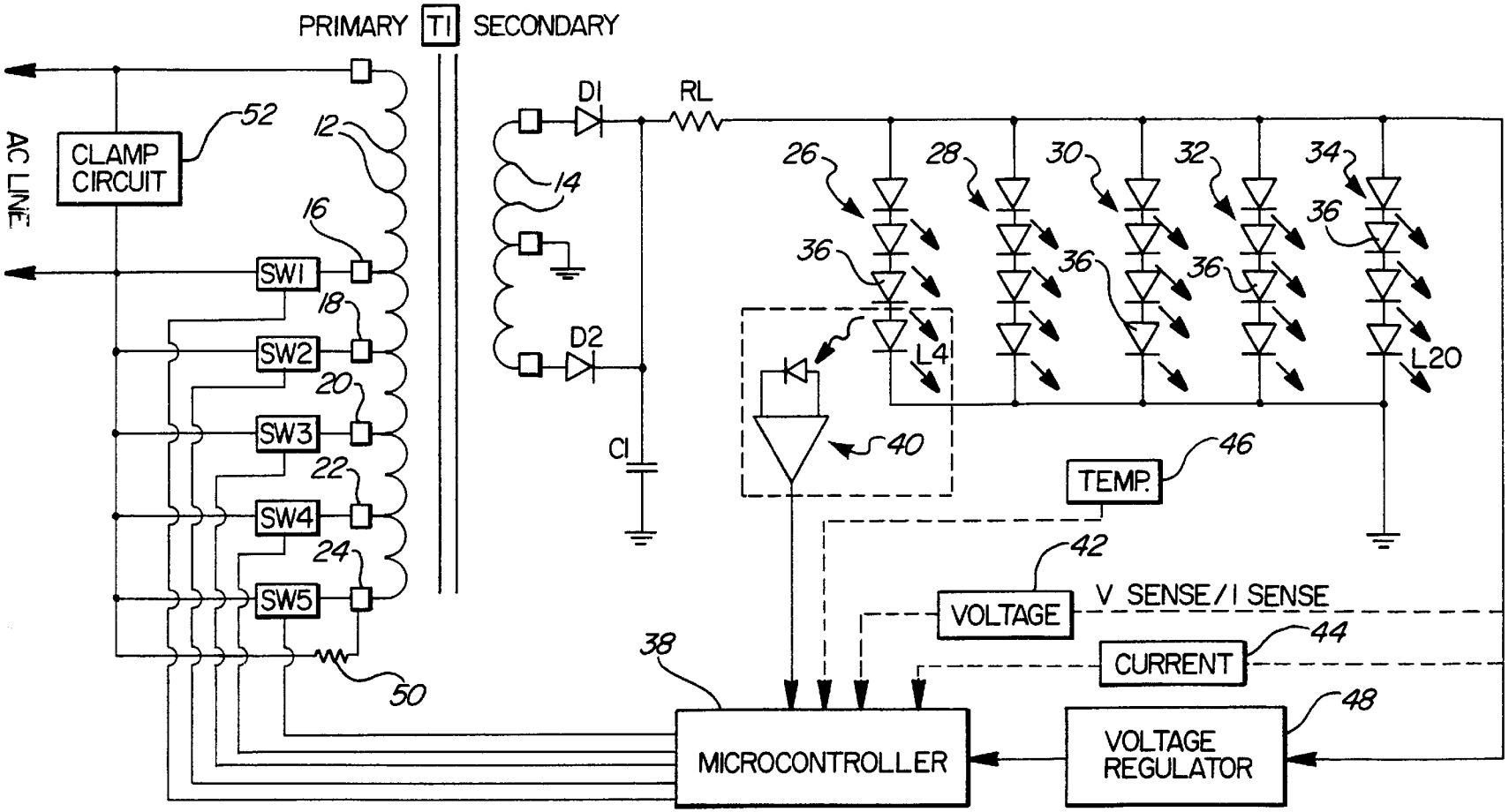
L20
34
36
32
36
30
36
28
26
36
L4
40
46
TEMP.
42
VOLTAGE
V SENSE / I SENSE
44
CURRENT
48
VOLTAGE REGULATOR
MICROCONTROLLER
38
RL
D1
D2
C1
14
SECONDARY
T1
PRIMARY
12
16
18
20
22
24
50
SW1
SW2
SW3
SW4
SW5
52
CLAMP CIRCUIT
AC LINE

TRANSFORMER TAP SWITCHING POWER SUPPLY FOR LED TRAFFIC SIGNAL

BACKGROUND OF THE INVENTION

1. Field of the Invention

The subject invention relates to an assembly including a power supply for supplying electrical power to an array of light emitting diodes (LEDs).

2. Description of the Prior Art

Light emitting diode (LED) signals are rapidly replacing conventional incandescent lamps in a variety of applications. Many LED signals, such as those for automotive uses, are directly operated from low voltage d.c. power sources. On the other hand, LED signals specifically designed to operate from the a.c. mains are becoming more common. These a.c. line operated devices, such as traffic signals usually include an integral a.c. to d.c. power supply to operate the LEDs. First generation power supplies for LED traffic signals consisted of simple reactive (capacitor) current limited circuits coupled to a full wave rectifier, ballast resistors and a network of series-parallel connected LEDs. The poor power factor and distortion performance of such simple power supplies, coupled with minimal line or load regulation has made their use unlikely for all but the least sophisticated, non safety critical applications. Second generation a.c. power supplies for LED signals usually employed linear current regulation, to accommodate some variance in power line supply voltage. The linear control element, usually a transistor and a power resistor was naturally dissipative and added undesirable heat to the LED signal assembly. Such self generated heat, when added to normal environmental heat, proved to be deleterious to the LED signals, which degraded rapidly in service.

Recent regulatory initiatives designed to assure the safety and quality of LED signals for traffic applications [Institute of Transportation Engineers, Interim LED Purchase Specification, July, 1998] have established minimum performance criteria for LED based signals. Among the specified performance parameters is a requirement for the LED signal to maintain a minimum luminous intensity over a relatively wide range of a.c. line voltage (85 to 135 Volts). The specified operating temperature range of −40° C. (−40° F.) to 74° C. (167° F.) is related to signal visibility issues and driver safety, and is necessary because most common (red) LEDs exhibit a diminution in luminous output of approximately −1% per ° C. increase in temperature. That is, using 25° C. as reference point, an uncontrolled LED signal might lose about 50% of its initial brightness when operated at 74° C. Such elevated temperatures have been shown to be rather common in traffic signal enclosures that are placed in service and are exposed to direct sunlight.

Third generation LED traffic signals are now available with efficient, switch mode power supplies that also provide power factor correction, and the necessary line regulation. When equipped with luminous output maintenance control circuitry as shown in U.S. Pat. No. 5,661,645, the power supply and control circuitry acting together can meet the proposed performance specifications for LED traffic signals.

Typically, the off line, switch mode power supplies used in existing traffic signals deliver between 100 volts and 300 volts of regulated d.c. to the LED array. The large number of LEDs necessary to meet the specified luminous output, suggests the use of long series strings of parallel connected LEDs. That is, the nominal 1.7 volt forward voltage drop across each LED (at 20 mA) requires some fifty eight devices to be connected in series. To prevent one local device failure from extinguishing the entire string, two or more LEDs are commonly connected in parallel, in a rudimentary current sharing arrangement.

For traffic signal applications, using nominally 1.2 Cd output LEDs (operated at 20 mA) a total of 180 LEDs were typically needed to fulfill the luminous requirements of an eight inch (200 mm) red LED traffic signal, while three hundred sixty devices would satisfy the requirements for twelve inch (300 mm) red signals. Of course, many other parameters influence the number of LEDs chosen for a particular application. Operating temperature, thermal management, permissible operating current and projected safe life are among some of the design variables.

Recently, very high luminous output LEDs have become commercially available because of advances in LED fabrication technology. Typically, these larger, copper heat sinked devices can provide up to ten times the light output of older, steel lead frame LEDs, albeit at four times the operating current. Reducing the number of LEDs in a signal assembly virtually ten fold, has dramatic implications for manufacture, reliability and naturally cost.

A simple step-down transformer, full wave rectified power supply could be designed to deliver the requisite voltage and current at very low cost. It would not provide the necessary line regulation nor would it compensate for the diminution in light output from the LEDs as they heated up. Of course, a fixed or programmable linear regulator could be used to provide the required regulation, but at a significant penalty in terms of power dissipation and temperature rise.

By means of example, assuming that proper operation at a reduced line voltage of 85 Volts is required (120 V. being the nominal design to voltage), then an approximately 30% increase in secondary transformer voltage would be required to maintain the 11.8 Volt d.c. supply. Taking into account the loss of luminous intensity with temperature approximately 50% increase in operating current may be required at 74° C. compared to the requisite current at 25° C. That is, to properly compensate for both specified line voltage variation and the added current needed to maintain luminous output at high temperature, the power supply would have to exhibit a nearly 80% adjustment range. Building in such voltage overhead with linear regulation is terribly inefficient. Minimally, a secondary d.c. voltage of 1.80×11.8 Volts or 21.2 Volts would be necessary. At nominal line voltage (120 V.A.C.) the difference between 21.2 Volts and the 11.8 Volt operating voltage (at 25° C.) would result in a dissipation of 3.3 Watts, which while not significant in and of itself, is a rather large percentage (87%) of the LED load power of 3.8 watts. Not accounting for transformer efficiency, the net power supply efficiency would be under 60%.

A low voltage, switch mode regulator could be used instead of the linear regulator postulated above, but the added cost, complexity and reduced reliability of this approach is not always commercially attractive.

Adjustable transformers have been used since the advent of alternating current power systems, since such devices are extraordinarily efficient. Mechanical turns changing transformers and adjustable tap switching transformers are used today in high power electrical distribution systems to compensate for line voltage variations, U.S. Pat. Nos. 5,408,171; 5,006,784 and 3,944,913 being examples of this art. The present invention addresses the problem of an adjustable, efficient, line transformer powered LED signal with a novel approach. U.S. Pat. No. 4,454,466 to Ritter discloses a tap switching transformer but does not suggest the combination with light emitting diodes. Other U.S. Pat. No. 4,717,889 to Engelmann, U.S. Pat. No. 4,816,738 to Nicolas, U.S. Pat. No. 4,896,092 to Flynn and U.S. Pat. No. 5,633,580 to Trainor et al also suggest tap switching transformers but not in combination with light emitting diodes to maintain the luminosity of the LEDs.

SUMMARY OF THE INVENTION AND ADVANTAGES

The present invention adapts the basic method of tap switching a power transformer in order to change the effective turns ratio between a primary and secondary winding. Such a ratiometrie change in transformer turns ratio effectively changes the voltage ratio of the transformer, thereby adjusting the d.c. output voltage of the power supply fed by such a transformer. More specifically, the method is characterized by automatically changing the number of effective turns of one of the windings in response to an operating parameter of the LEDs for maintaining the luminous output of the LEDs above a predetermined level.

An assembly for implementing the invention comprises a transformer having a primary winding and a secondary winding each having a plurality of turns, a plurality of taps for changing the number of effective turns of one of the windings, and an array of LEDs for producing a luminous output in response to power supplied by the transformer. The assembly is characterized by a controller for automatically selecting one of the taps in response to an operating parameter of the LEDs for maintaining the luminous output of the LEDs above a predetermined level.

BRIEF DESCRIPTION OF THE DRAWINGS

Other advantages of the present invention will be readily appreciated as the same becomes better understood by reference to the following detailed description when considered in connection with the accompanying drawings wherein FIG. 1 shows a schematic electrical diagram of the subject invention.

DETAILED DESCRIPTION OF THE PREFERRED EMBODIMENT

Referring to the Figures, wherein like numerals indicate like or corresponding parts throughout the several views, an assembly including a power supply and an array of light emitting diodes (LEDs) is shown in FIG. 1.

The assembly includes a transformer T1 having a primary winding and a secondary winding each having a plurality of turns 12 for the primary and 14 for the secondary. A plurality of taps 16, 18, 20, 22 and 24 are included on the primary winding for changing the number of effective turns of the windings 12.

An array of LEDs produce a luminous output in response to power supplied by the transformer T1. The LEDs are divided into strings 26, 28, 30, 32 and 34 with a plurality of LEDs 36 in series with one another in each string.

The assembly is characterized by a controller 38 for automatically selecting one of the taps 16, 18, 20, 22 and 24 in response to an operating parameter of the LEDs 36 for maintaining the luminous output of the LEDs 36 above a predetermined level. The controller 38 develops an output signal in response to an operating parameter of the LEDs 36 which drives one of a plurality of switches SW 1 through SW 5, which, in turn, control or select the taps 16, 18, 20, 22 or 24. The switches SW 1 through SW 5 are connected to the controller 38 by individual electrical leads.

In one embodiment, the controller 38 includes a measurement device, generally indicated at 40, for measuring luminous output of the LEDs 36 as the operating parameter. The luminous detector 40 comprises an LED light detector and associated circuit for measuring the luminous output of one or more of the LEDs 36. Alternatively, or in conjunction with the luminous detector, the controller 38 may include a measurement device 42 for measuring voltage across the LEDs 36 as the operating parameter. Yet another measurement device which the controller 38 may include is a measurement device 44 for measuring current through the LEDs 36 as the operating parameter. In addition, the controller 38 may include a measurement device 46 for measuring the temperature of the LEDs 36 as the operating parameter.

The assembly includes a voltage regulator 48 between the secondary winding and the controller 38. A resistor 50 is disposed in parallel with one 24 of the taps 16, 18, 20, 22 or 24. A clamping circuit 52 is in parallel with a plurality of turns 12 of one of the windings.

As shown in FIG. 1., a conventional, linear power supply using a line powered transformer T1 is configured as a center tapped, full wave rectifier d.c. source. Naturally, a four diode, bridge rectifier could also be used, as could a less efficient, single diode, half wave rectifier. The d.c. filtering of the rectified a.c. is provided by capacitor C1. As shown, the transformer is provided with multiple input voltage taps 16, 18, 20, 22 or 24, which is common practice, to allow the supply to be adapted to the locally available line voltage. Selection of the appropriate tap is generally done manually (once). Some wide range, adjustable linear power supplies [MCM Electronics, Centerville Ohio, MCM 72-2005 for example] use relay switching of transformer taps to minimize voltage regulator dissipation. Such switching is done in response to the voltage output selection of the power supply, but it is not utilized as the primary regulation mechanism, nor is tap selection feedback controlled.

In the present invention, a multi-tapped power transformer T1 is the primary voltage (and power) regulating mechanism for maintaining the luminous output of an LED signal above a specified minimum level. The selection of appropriate taps 16, 18, 20, 22 or 24 is accomplished via a feedback network in response to one or several measured parameters. As shown in FIG. 1, transformer T1 is provided with five selectable primary taps 16, 18, 20, 22 and 24. For example, the first tap 16 may be designed for an input voltage of 75 Volts; the second tap 18, 90 Volts; the third tap 20, 105 Volts; the fourth tap 22, 120 Volts and the fifth tap 24, 135 Volts. These specified voltages result in a secondary a.c.r.m.s, voltage of approximately 12 Volts, at the specified voltages. In the example shown, secondary regulation would be on the order of 12.5%. That is, when the input line voltage dropped from nominal (120 V.A.C.) to 105 V.A.C., the third tap 20 would be selected, thereby adjusting the secondary voltage upwards by the requisite amount. Conversely, should the input line rise to 135 volts, the fifth tap 24 would be selected, bringing the secondary voltage back down to its nominal 12 volt r.m.s. level.

Adjusting the operating current of the LED array would naturally change the luminous intensity of the LEDs, and the secondary transformer voltage would obviously determine the average (d.c.) current through the LED load. Since the transformer secondary voltage is a direct function of the transformer turns ratio, selection of primary (or secondary) taps will change the light output of the array.

Selection of the appropriate taps 16, 18, 20, 22 or 24 is done automatically in response to a measurement performed on the load side of the transformer T1. In its simplest configuration, a micro controller 38 with analog sensing capabilities could monitor the net d.c. voltage across the load, or the current flowing to the load, and compensation for any changes in those measured parameters by picking a suitable transformer tap 16, 18, 20, 22 or 24. The appropriate tap 16, 18, 20, 22 or 24 would keep the measured parameter constant if desired, or the measured parameter (voltage 42 or current 44) could be made a function of a third variable such as temperature 46. Temperature sensor 46, for example, could provide the micro controller with an input signal related to the temperature of the LED array, and thereby allow for luminous output maintenance over a wide temperature range.

The most sophisticated regulation system, for use with LED signals, would be provided by monitoring the actual luminous output 40 of the LED array, and compensating for deviations from a specified light output by automatically selecting the appropriate transformer tap. Sensing the luminous output from one or more LEDs in the array allows the regulation system to compensate for line voltage variations and luminous depreciation of the LEDs with temperature and age. In actual practice, it may be more convenient to monitor a "sample" LED which while not actually part of the signal array, is forced to perform in the same manner (equal current) and is subject to the same operating conditions (temperature). As shown, light sensor 40, develops a signal proportional to the luminous output of the LED array, and provides the micro controller 38 with either voltage, current, resistance or a variable frequency input. The controller 38 is responsive to such measured variables and by means of a resident program (algorithm) develops a suitable output signal which drives one of several switches (SW 1 through SW 5). These switches are typically solid state, a.c. relays such as Triac, optoisolated devices. The switches may be relays of any sort however, if they are reliable. Note that while transformer primary taps are shown, secondary (low voltage) taps are equally useful, and may be used instead of the switched primary taps or in addition to primary taps to provide better regulation.

The transformer taps 16, 18, 20, 22 or 24 may be regularly spaced or unevenly spaced in terms of turns or transformer voltage ratio. Furthermore, fully isolated windings could be employed, which when driven by a binary coded controller, would provide thirty two discrete control steps with only five windings. If primary-secondary transformer isolation is not required and higher voltage operation is acceptable, a simple tapped auto-transformer topology could be used, with the attendant reduction in cost. Note that for purposes of this invention, an auto-transformer with a winding consisting of combined primary and secondary windings is equivalent in function to a transformer with separate windings, which are specified herein.

While the use of a digital micro controller or micro processor is preferred, other feed back control elements could be utilized, with equally beneficial results. For example, an integrated multilevel window comparator (in place of the controller 38) such as an LM 3914 dot-bar graph driver I.C. could be used to actuate the tap switches in response to the measured input variable.

On startup, when none of the tap switches SW 1 through SW 5 may be closed, the micro controller will still require operating power. A simple high impedance path around the switches can be provided by initializing resistor 50. The minimal current requirement for typical micro controllers, microprocessors, and the like, may easily be provided by a low power voltage regulator 48, which receives sufficient power from the transformer secondary even if no taps are switch selected, because of the initializing resistor 50. Alternatively, such initializing current may be provided reactively. Circulating current drawn by resistor 50 during normal operation is trivial, and any dissipation concerns in resistor 50 could be mitigated by using a small capacitor in place of resistor 50, causing the current to be out of phase with the voltage across the initiation capacitor, minimizing power dissipation.

As the power consumption of LED signals continues to decrease because of higher LED efficacies, the difficulty in operating these devices with existing control hardware increases. Commonly used conflict monitors that prevent traffic signal conflicts depend on relatively low "off state" impedances in order to function properly. Low power LED signals often require adaptive clamping circuits to ensure system compatibility. To that end, an adaptive clamp circuit 52, as shown in U.S. Pat. No. 5,661,645, may be attached across the a.c. line input terminals on the primary of the transformer T1 to load the circuit adequately. Alternatively, the adaptive clamping circuit 52 may be placed across the secondary of the transformer T1, with the requisite changes in component selection.

The use of far fewer LEDs in signals requires a different power supply approach, as less LEDs are required per series string while some form of operating redundancy needs to be retained. That is, the power supply is now required to deliver a lower voltage at a higher current. For example, an array of twenty high output LEDs (such as Hewlett Packard, automotive "SnapLeds") may be connected as five parallel strings of four series LEDs each. At a 25° C. ambient temperature each LED would exhibit a forward voltage drop of approximately 2.7 Volts at a forward current of 70 mA. Each series string would drop nominally 10.8 Volts, and the ballast resistor RL would typically add 1 volt, requiring the full wave rectifier supply to deliver 11.8 volts at 0.35 A.

Accordingly, the invention also provides a method of powering an array of light emitting diodes (LEDs 36) comprising the steps of supplying power to the LEDs 36 from a transformer T1 having a primary winding and a secondary winding each having a plurality of turns 12 and 14 and characterized by automatically changing the number of effective turns 12 and 14 of one of the windings in response to an operating parameter of the LEDs 36 for maintaining the luminous output of the LEDs 36 above a predetermined level. The measurement of the operating parameter may be any one of or any combination of measuring voltage across the LEDs 36, measuring current through the LEDs 36, measuring the temperature of the LEDs 36, or measuring 40 the luminous output of the LEDs 36. The method can be further defined as automatically changing the number of effective turns 12 of the primary winding with a controller 38 and regulating 48 the voltage between the secondary winding and the controller 38.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A power supply and an array of light emitting diodes (LEDs (36)), the assembly comprising:

a transformer (T1) having a primary winding and a secondary winding each having a plurality of turns (12 and 14), a plurality of taps (16, 18, 20, 22 and 24) for changing the number of effective turns (12 and 14) of one of the windings, an array of LEDs (36) for producing a luminous output in response to power supplied by said transformer (T1), and a controller (38) for automatically selecting one of said taps (16, 18, 20, 22 and 24) in response to an operating parameter of said LEDs (36) for maintaining the luminous output of said LEDs (36) above a predetermined level, said controller (38) including a measurement device (46) for measuring the temperature of said LEDs (36) as said operating parameter.

2. A power supply and an array of light emitting diodes (LEDs (36)), the assembly comprising;

a transformer (T1) having a primary winding and a secondary winding each having a plurality of turns (12 and 14), a plurality of taps (16, 18, 20, 22 and 24) for changing the number of effective turns (12 and 14) of one of the windings, an array of LEDs (36) for producing a luminous output in response to power supplied by said transformer (T1), and a controller (38) for automatically selecting one of said taps (16, 18, 20, 22 and 24) in response to an operating parameter of said LEDs (36) for maintaining the luminous output of said LEDs (36) above a predetermined level, said controller (38) including a measurement device (40) for measuring luminous output of said LEDs (36) as said operating parameter.

3. A power supply and an array of light emitting diodes (LEDs (36)), the assembly comprising;

a transformer (T1) having a primary winding and a secondary winding each having a plurality of turns (12 and 14), a plurality of taps (16, 18, 20, 22 and 24) for changing the number of effective turns (12 and 14) of one of the windings, an array of LEDs (36) for producing a luminous output in response to power supplied by said transformer (T1), and a controller (38) for automatically selecting one of said taps (16, 18, 20, 22 and 24) in response to an operating parameter of said LEDs (36) for maintaining the luminous output of said LEDs (36) above a predetermined level, said taps (16, 18, 20, 22 and 24) being associated with said primary winding and including a voltage regulator (48) between said secondary winding and said controller (38), a resistor (50) in parallel with one of said taps (16, 18, 20, 22 and 24).

4. A method of powering an array of light emitting diodes (LEDs (36)) comprising the steps of;

supplying power to the LEDs (36) from a transformer (T1) having a primary winding and a secondary winding each having a plurality of turns (12 and 14), and automatically changing the number of effective turns (12 and 14) of one of the windings in response to an operating parameter of the LEDs (36) for maintaining the luminous output of the LEDs (36) above a predetermined level, and measuring the temperature of the LEDs (36) as the operating parameter.

5. A method of powering an array of light emitting diodes (LEDs (36)) comprising the steps of;

supplying power to the LEDs (36) from a transformer (T1) having a primary winding and a secondary winding each having a plurality of turns (12 and 14), and automatically changing the number of effective turns (12 and 14) of one of the windings in response to an operating parameter of the LEDs (36) for maintaining the luminous output of the LEDs (36) above a predetermined level, and measuring (40) the luminous output of the LEDs (36) as the operating parameter.

* * * * *